US009350100B2

(12) United States Patent
Takahashi

(10) Patent No.: US 9,350,100 B2
(45) Date of Patent: May 24, 2016

(54) CONNECTOR HAVING A CONTACT WITH CONTACT SURFACES INCLINED IN OPPOSITE DIRECTIONS

(71) Applicant: Sensata Technologies Massachusetts, Inc., Attleboro, MA (US)

(72) Inventor: Hideyuki Takahashi, Sizuoka-ken (JP)

(73) Assignee: Sensata Technologies, Inc., Attleboro, MA (US)

( * ) Notice: Subject to any disclaimer, the term of this patent is extended or adjusted under 35 U.S.C. 154(b) by 0 days.

(21) Appl. No.: 14/527,847

(22) Filed: Oct. 30, 2014

(65) Prior Publication Data

US 2015/0126071 A1 May 7, 2015

(30) Foreign Application Priority Data

Nov. 1, 2013 (JP) ..... 2013227985

(51) Int. Cl.
*H01R 13/11* (2006.01)
*H01R 12/72* (2011.01)
*H01R 12/73* (2011.01)

(52) U.S. Cl.
CPC ..... *H01R 12/724* (2013.01); *H01R 12/732* (2013.01); *H01R 13/113* (2013.01)

(58) Field of Classification Search
CPC .... H01R 13/04; H01R 13/187; H01R 13/113; H01R 13/112; H01R 13/11
USPC ..... 439/842, 843, 851–853, 629
See application file for complete search history.

(56) References Cited

U.S. PATENT DOCUMENTS 5,427,553 A * 6/1995 Tsuji ..... H01R 13/187 439/842
6,050,862 A * 4/2000 Ishii ..... H01R 13/193 439/843
7,513,806 B2 * 4/2009 Noda ..... H01R 13/04 439/852
7,976,326 B2 * 7/2011 Stoner ..... H01R 13/193 439/295
8,545,240 B2 * 10/2013 Casher ..... H01R 29/00 439/108
8,764,464 B2 * 7/2014 Buck ..... H01R 13/514 439/108

* cited by examiner

*Primary Examiner* — Chandrika Prasad
(74) *Attorney, Agent, or Firm* — Chapin IP Law, LLC

(57) ABSTRACT

[Problem(s)]
A board to board connector is disclosed to provide desirable electrical connection between contacts.
[Means to Solve the Problem(s)]
A board to board connector according to the present invention comprises a male connector 10 and a female connector 20. The male connector 10 comprises a pair of male contacts 100A, 100B and the female connector 20 comprises a pair of female contacts 200A, 200B. The male contacts 100A, 100B comprise protruding portions 109A, 109B which are elastically deformable, and the female contacts 200A, 200B comprise contact portions 208A, 208B which contact the protruding portion 109A, 109B. The contact portion 208B comprises a first inclined surface 201 A which inclines in a direction perpendicular to another direction in which the protruding portion moves and a second inclined surface 210B.

15 Claims, 9 Drawing Sheets

Enlarged sectional view taken along line A-A

Enlarged sectional view taken along line B1-B1

Enlarged sectional view taken along line B2-B2

CONNECTOR HAVING A CONTACT WITH CONTACT SURFACES INCLINED IN OPPOSITE DIRECTIONS

RELATED APPLICATION

This application is related to and claims priority to Japanese Patent Application No. 2013-227985 filed Nov. 1, 2013, the entire teachings of which are incorporated herein by this reference.

FIELD OF THE INVENTION

The present invention relates to a connector for connecting a substrate, electronics and a semiconductor chip etc., and more particularly, to a board-to-board connector.

BACKGROUND ART

A plurality of circuit boards are mounted on an electronic device such as a personal computer and a game machine. For example, a plurality of circuit boards are connected to a mother board via connectors, which are removable as needed.

Such board-to-board connector is disclosed in the patent document 1. The board-to-board connector comprises: a plug connector which has a base member provided with a projecting portion extending in the longitudinal direction and has contacts aligned in the longitudinal direction; a receptacle connector which has a base member provided with an opening extending in the longitudinal direction and has contacts aligned in the longitudinal direction; and operation lever mechanisms provided on the both sides of the ends of the plug connector. Each operation lever mechanism includes a pair of levers to attach the plug connector to the receptacle connector or detach the plug connector from the receptacle connector in accordance with the rotational direction of the pair of levers.

RELATED ART DOCUMENT

Patent Document

Patent document 1: JP2007-80641A

SUMMARY OF THE INVENTION

Problem(s) to be Solved

FIG. 1(A) is a plan view of a conventional board-to-board connector and FIG. 1(B) is a sectional view taken along line A-A of FIG. 1(A). As shown, a board-to-board connector 1 includes a male connector 10 and a female connector 20. The male connector 10 includes a plurality of male contacts 12 aligned in the longitudinal direction, a male body supporting the male contacts 12, and tabs 16 attached to the both ends of the male body 14 for assisting in securing the male connector to the substrate. The female connector 20 includes a plurality of female contacts 22 which can mate with the male contacts 12 respectively, a female body 24 supporting the female contacts 22 aligned in the longitudinal direction, and tabs 26 attached to the both ends of the female body 24 for assisting in securing the female connector to the substrate.

When an insertion portion 18 extending in the longitudinal direction of the male connector 10 is inserted into an opening 28 extending in the longitudinal direction of the female connector 20, each male contact 12 mates with each female contacts 22 respectively so that the electrical connection is provided between the contacts. The male contact 12 is provided with a cantilever-shaped movable contact having an elastic property, while the female contact 22 is provided with a stationary contact. When the male contact 12 contacts with the female contact 22, the movable contact moves against the stationary contact with a certain load applied so that the male contact 12 can wipe the female contact 22 to remove extraneous substances attached thereto.

However, the extraneous substances which are firmly attached to the surface of the contact or the body cannot be wiped completely, so that such substances remain between the female contacts at the mating. Intervening of the extraneous substances prevent contacts from fine electrical connections and causes a loose connection.

An object of the present invention is to provide a board-to-board connector which can resolve the above conventional problems and provide fine electrical connections between contacts.

Means to Solve the Problems

According to the present invention, a male contact and a female contact are connected each other. The male contact comprises an elastically deformable projection portion at the end thereof, while the female contact comprises a contact surface for making contact with the projection portion. The contact surface extends in a movement direction of the projection portion and comprises a first inclined surface which is inclined in a first direction different from the movement direction of the projection portion and a second inclined surface which is inclined in a second direction opposite to the first direction.

Preferably, the first and second inclined surfaces are continuous and a slope is provided in the height difference between the first and second inclined surfaces. Preferably, the inclined angle of the first inclined surface is equal to that of the second inclined surface. Preferably, the first and second inclined surfaces are spherical. Preferably, a pair of female contacts are disposed such that a pair of contact surfaces is opposite each other, while a pair of male contacts are disposed such that a pair of projection portions contacts the contact surfaces. Preferably, the pair of contact surfaces are supported so as to contact the upper and bottom surfaces of the opening, while the pair of projection portions are elastically supported at the upper and bottom surfaces of an insertion portion of the opening to which the projection portion is inserted. Preferably, the connector further comprises a male connector and a female connector. The male connector comprises a plurality of male contacts and the insertion portion. The female connector comprises a plurality of female contacts and the opening. When the insertion portion is inserted into the opening, the plurality of male contacts are connected to the plurality of female contacts respectively. Preferably, the male connector and the female connector are secured to the substrate through the male contact and the female contact respectively.

Advantageous Effect of the Invention

According to the present invention, the first and second inclined surfaces are provided to the contact surface of the female contact to perform a wiping operation two-dimensionally so that extraneous materials firmly attached to the contact surface can be removed, which cannot be conventionally eliminated.

MODE FOR CARRYING OUT THE INVENTION

Now, a best mode for carrying out the present invention will be descried in detail with reference to the drawings. The present invention is applied to a connector having a male contact and a female contact. Such connector provides electrical interface with various devices, such as a substrate, electronics and a semiconductor package. As a preferred embodiment, examples in which the present invention is applied to a board-to-board connector will be described.

[Embodiment]

Figure 1A:
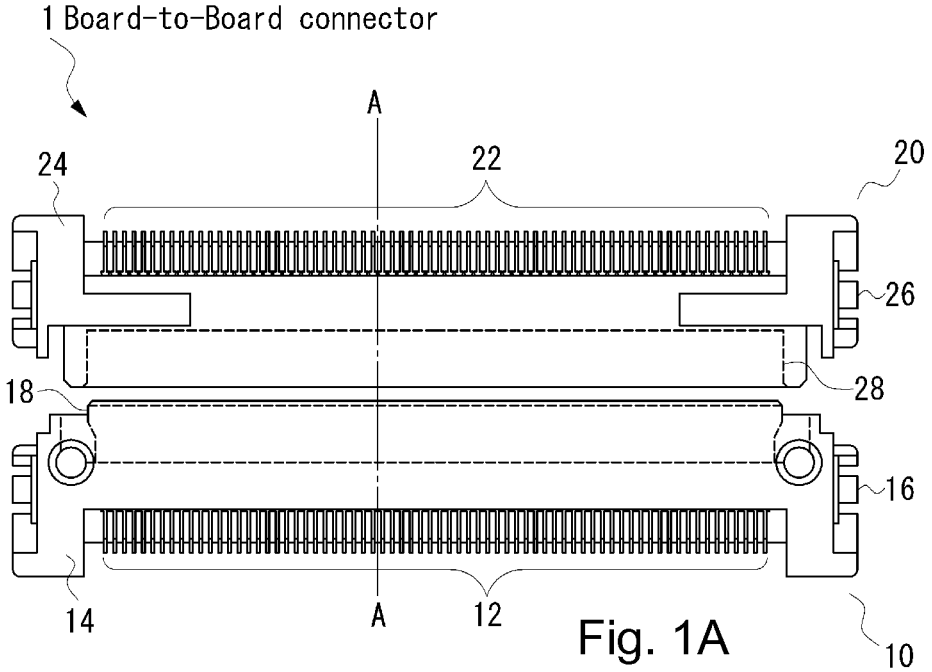
FIG. 1(A) is a schematic plan view of a board-to-board connector and FIG. 1(B) is a sectional view taken along line A-A of FIG. 1(A).

According to the present invention, a board-to-board connector comprises a male connector 10 and a female connector 20 as shown in FIG. 1. However, each male contact and each female contact used to the connector have different configurations from conventional contacts.

Figure 1B:
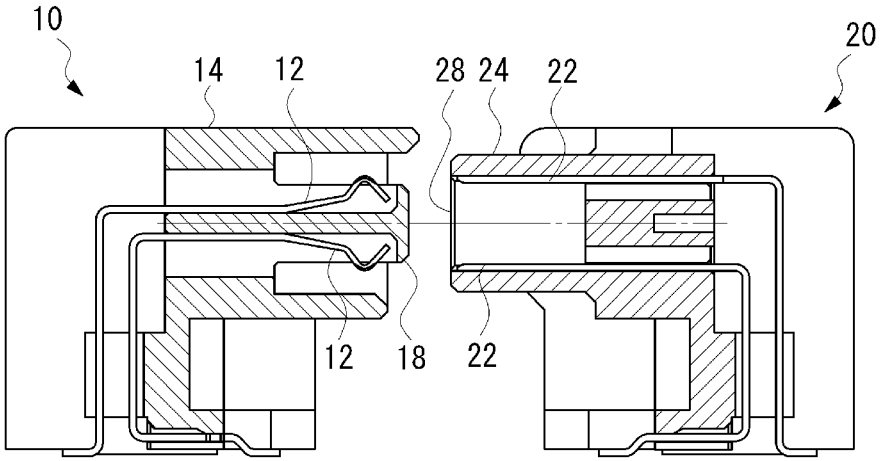
Figure 2:
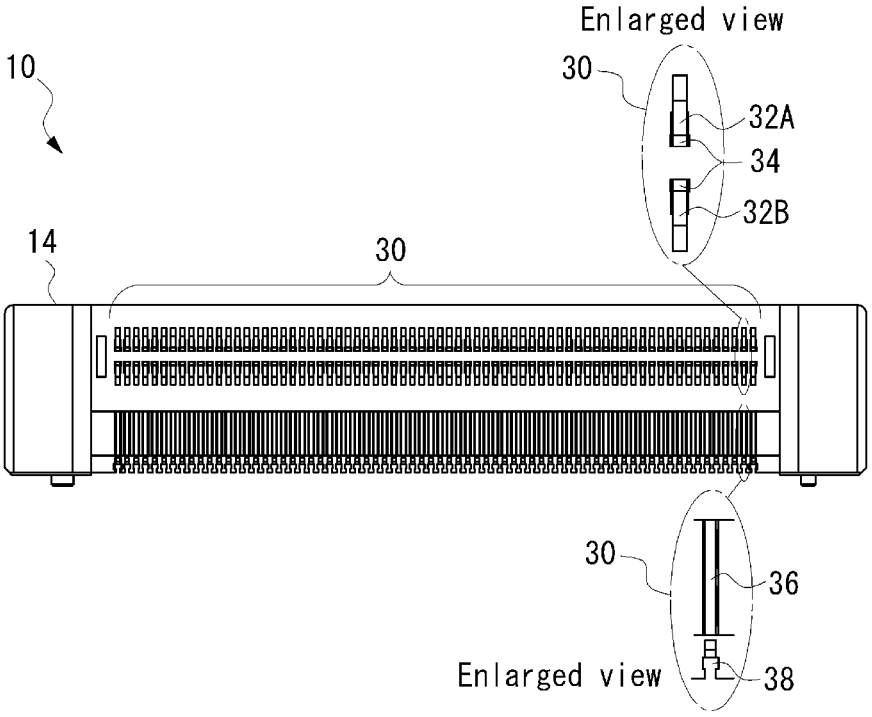
FIG. 2 is a back elevation of a male body according to an embodiment of the present invention.

FIG. 2 shows a back elevation of a male body of the male connector 10. Same numerals indicate the same configurations between FIGS. 1 and 2. The male connector 10 comprises a male body 14 which is generally rectangular-shaped and extends in a longitudinal direction. The male body 14 is formed with a plurality of contact mounting portions 30, each portion 30 is slit-shaped for mounting a pair of male contacts 100A, 100B. The plurality of contact mounting portions 30 are arranged in the longitudinal direction of the male body 14. The pair of male contacts 100A, 100 B is mounted to one contact mounting portions 30.

Each contact mounting portion 30 includes a pair of openings 32A, 32B which are rectangular shaped, and partition walls 34 are provided between the openings 32A, 32B. The partition wall 34 of each contact mounting portion 30 provides the insertion portion 18 of the male body 14. The male contact 100A is inserted into the opening 32A and the male contact 100B is inserted into the opening 32B. Each contact mounting portion 30 further comprises a groove 36 which is rectangular-shaped for aligning the male contacts 100A, 100B and a groove 38 for securing the end 102B of the contact.

Figure 3:
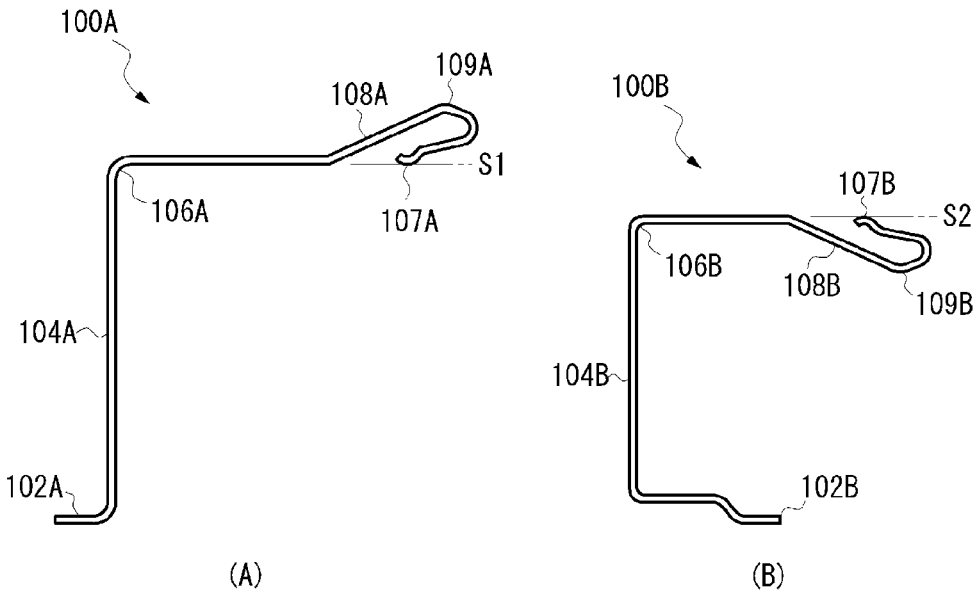
FIG. 3 is a side view of a male contact according to an embodiment of the present invention.

FIGS. 3(A) and 3(B) show a sectional view of the pair of the male contacts 100A, 100B. The male contact 100A is formed by stamping a sheet of metal such as copper alloy. The male contact 100A comprises a base portion 102A, an extending portion 104A extending straightly from the base portion 102A, a bent portion 106A bent at an approximately right angle from the extending portion 104A, and a contact portion 108A extending in a cantilever so as to be inclined from the bent portion 106A. The width from the base portion 102A to the contact portion 108A is substantially equal.

The base portion 102A is substantially L-shaped and the flat portion thereof is connected to an electrode pad of a substrate by soldering, etc. (not shown). The contact portion 108A is inclined from the bent portion 106A to be cantilevered. A protruding portion 109A is formed at the middle of the contact portion 108A. A protruding portion 107A is also formed at the tip end of the contact portion 108A. The protruding portion 109A is formed by, for example, bending the contact portion 108A. The protruding portion 109A may be plated to prevent the wear thereof. In a more preferred embodiment, the tip end of the protruding portion 109A is in a sharply-pointed shape, such as spherical, conical or pyramid shape. This shape enables improved wiping functionality for removing extraneous substances or particles. The protruding portion 107A is also formed by bending. As described below, a certain contact pressure can be applied with the protruding portion 109A by contacting the protruding portion 107A with a top surface S1 of the partition wall 34.

When the extending portion 104A is accommodated in the groove 36 and the contact portion 108A is inserted into the opening 30A, the bent portion 106A is press-fitted between the side surfaces of the opening 30A, the protruding portion 107A is abutted against the top surface S1 of the partition wall, and the contact portion 108A is supported to be separated from the top surface S1 of the partition wall 34. This allows the protruding portion 109A of the contact portion 108A to be acted as a movable contact.

The male contact 100B has the same configuration as the male contact 100A. That is, the male contact 100B is formed by stamping a sheet of metal such as copper alloy and comprises a base portion 102B, an extending portion 104B extending at straight from the base portion 102B, a bent portion 106B bent at an approximately right angle from the extending portion 104B, and a contact portion 108A extending in a cantilever so as to be inclined from the bent portion 106A. The width from the base portion 102B to the contact portion 108B is substantially equal, which is substantially equal to that of the male contact 100A.

The base portion 102B is substantially L-shaped and the flat portion thereof is connected to an electrode pad of a substrate by soldering, etc. (not shown). The contact portion 108B is inclined from the bent portion 106A to be cantileved. A protruding portion 109B is formed at the middle of the contact portion 108B. A protruding portion 107B is also formed at the tip end of the contact portion 108B. The protruding portion 109B is formed by, for example, bending the contact portion 108B. The protruding portion 109B may be plated to prevent the wear thereof. In a more preferred embodiment, the tip end of the protruding portion 109B is in a sharply-pointed shape, such as spherical, conical or pyramid shape. This shape enables improved wiping functionality for removing extraneous substances. The protruding portion 107B is also formed by bending. As described below, the protruding portion 107B can provide a certain contact pressure with the protruding portion 109B by abutting with a bottom surface S2 of the partition wall 34.

When the extending portion 104B is accommodated in the groove 36 and the contact portion 108B is inserted into the opening 32B, the bent portion 106B is press-fitted between the side surfaces of the opening 32B, the protruding portion 107B is abutted against the bottom surface S2 of the partition wall, and the contact portion 108B is supported to be separated from the bottom surface S2 of the partition wall 34. This allows the protruding portion 109B of the contact portion 108B to be acted as a movable contact. The base portion 102B inserted into the groove 38 is disposed at the opposite side to the base portion 102A in the bottom surface of the male body.

Thus, when the pair of male contacts 100A, 100B are mounted with the contact mounting portion 30, the pair of contact portions 108A, 108B are disposed at the above and below of the insertion portion 18, as shown in FIG. 1(B), so as to be elastically deformable in the vertical direction of the partition wall.

Figure 4:
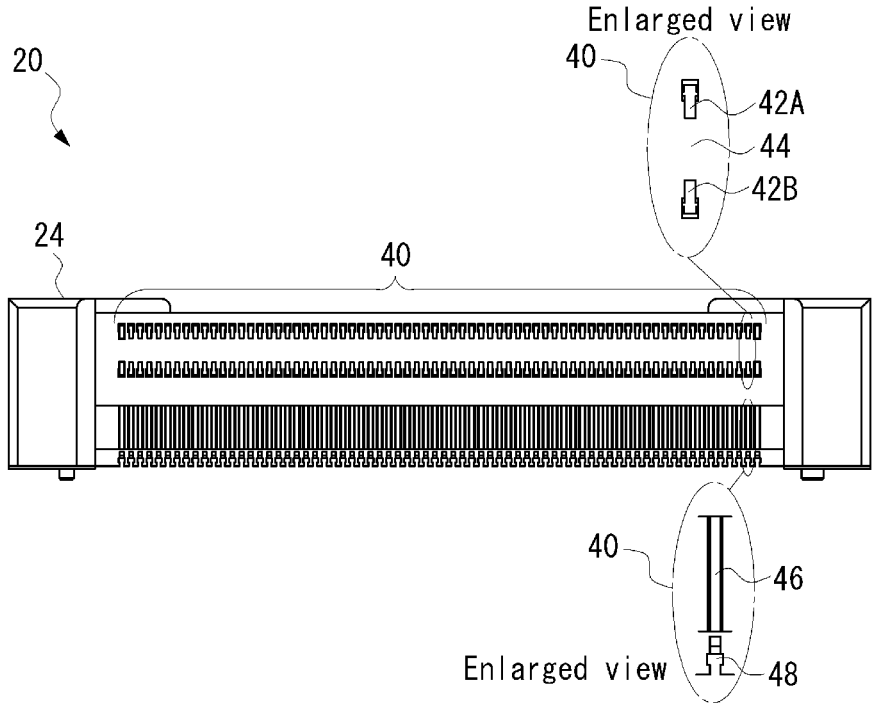
FIG. 4 is a back elevation of a female body according to an embodiment of the present invention.

FIG. 4 shows a back elevation of a female body of the female connector 20. The female connector 20 comprises a female body which is substantially rectangular-shaped and extends in the longitudinal direction. The female body is formed with slit-shaped contact mounting portions 40 for attaching female contacts 200A, 200B respectively. The plurality of the contact mounting portions 40 are arranged in the longitudinal direction of the female body 24. Each contact mounting portion 40 mounts the pair of the female contact 200A, 200B.

Each contact mounting portion 40 comprises a pair of openings 42A, 42B which are rectangular-shaped. A partition wall 44 is formed between the openings 42A, 42B. The partition wall 44 serves as a stopper 28A when the insertion portion 18 is inserted into the opening 28 (see FIG. 9). The female contact 200A is inserted into the opening 42A and the female contact 200B is inserted into the opening 42B. Each contact mounting portion 40 further comprises a groove 46 which is rectangular-shaped for aligning the female contacts 200A, 200B and a groove 48 for securing the end 202B of the contact.

Figure 5:
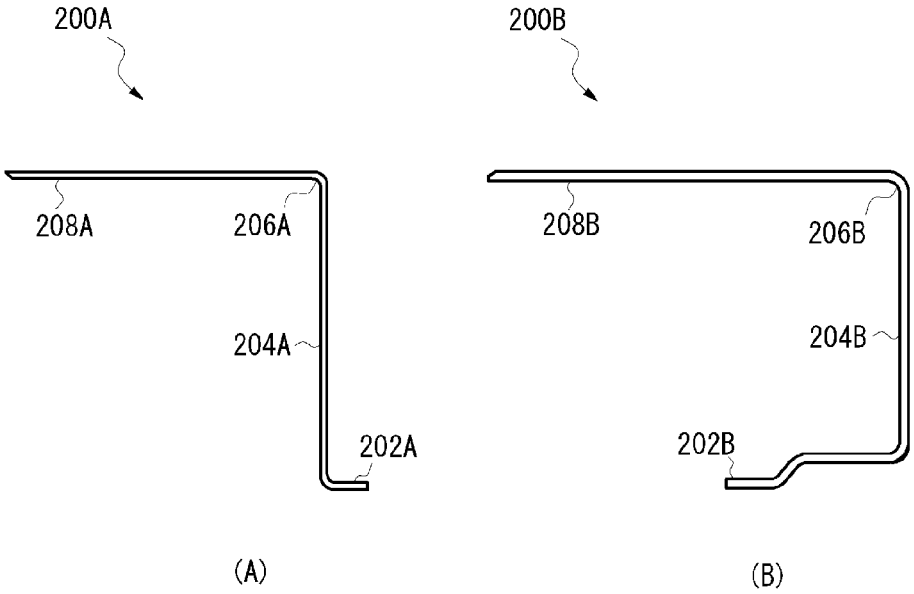
FIG. 5 is a side view of a female contact according to an embodiment of the present invention.

FIGS. 5(A) and 5(B) show a pair of female contacts 200A, 200B. The female contact 200A is formed by stamping a sheet of metal such as copper alloy. The female contact 200A comprises a base portion 202A, an extending portion 204 linearly extending from the base portion 202A, a bent portion bent from the extending portion substantially at right angle, and a contact portion 208A horizontally extending form the bent portion 206A. The width from the base portion 202A to the contact portion 208A is substantially equal. When the extending portion 204A is secured in the groove 46 and the contact portion 208A is inserted into the opening 42A, the contact portion 208A presses the top surface of the opening 28.

The female contact 200B has the same configuration as the female contact 200A. That is, the female contact 200B is made of a sheet of metal such as copper alloy. The female contact 200B comprises a base portion 202B, an extending portion 204B linearly extending from the base portion 202B, a bent portion bent from the extending portion substantially at right angle, and a contact portion 208B horizontally extending form the bent portion 206B. The width from the base portion 202B to the contact portion 208B is substantially equal, which is equal to the width of the female contact 200A. When the extending portion 204B is secured in the groove 46 and the contact portion 208A is inserted into the opening 42B, the contact portion 208B presses the bottom surface of the opening 28 and the base portion 202B inserted into the groove 46 is disposed at the opposite side to the base portion 202A in the bottom surface.

Thus, when the pair of female contacts 200A, 200B is mounted with the contact mounting portion 40, the pair of contact portions 208A, 208B are disposed at the top and bottom surfaces of the opening 28 respectively such that they are opposed to each other. When the insertion portion 18 of the male connector 10 is inserted into the opening 28 of the female connector 20, the contact portion 108A, 108B of the male contacts 100A, 100B are respectively contacted to the contact portions 208A, 208B of the female contacts 200A, 200B.

Figure 6A:
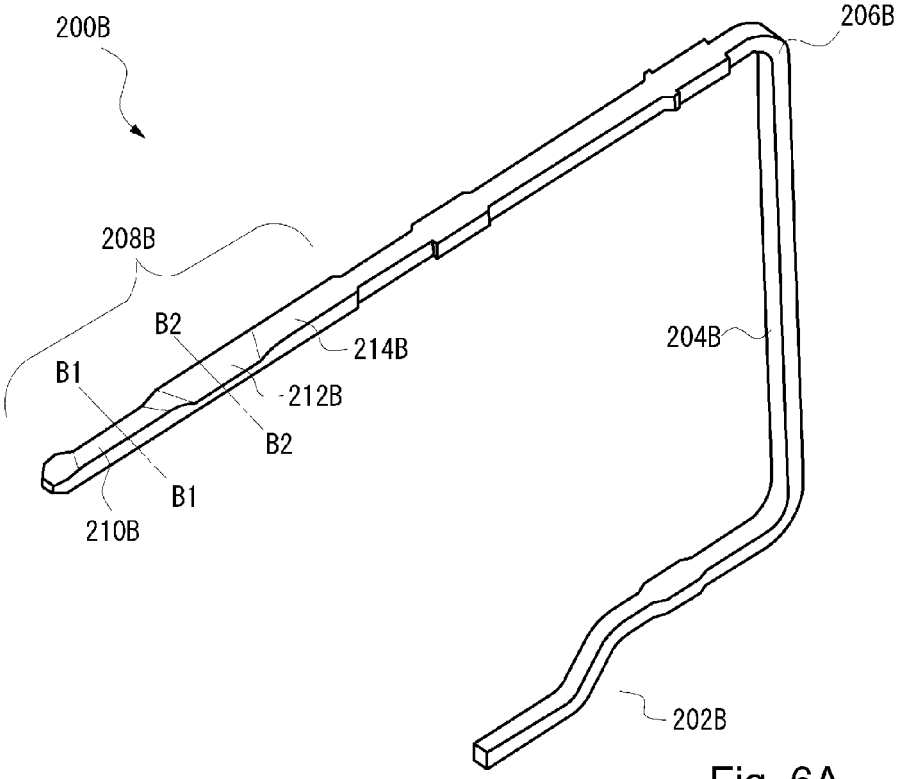
FIG. 6(A) is a perspective view of the female contact.
Figure 6B:
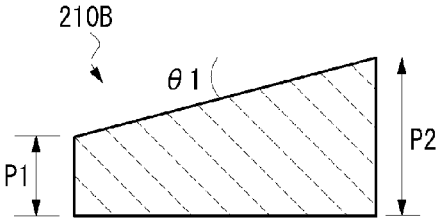
FIG. 6(B) is a sectional view taken along line B1-B1 of FIG. 6(A)
Figure 6C:
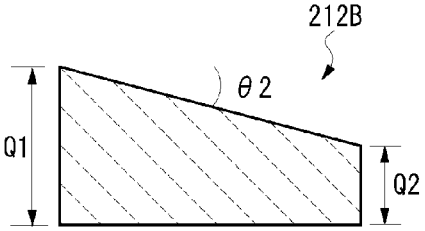
FIG. 6(C) is a sectional view taken along line B2-B2 of FIG. 6(A) according to an embodiment of the present invention.

FIG. 6(A) is a perspective view of the female contact 200B according to the present invention. FIG. 6(B) is a sectional view taken along line B1-B1 and FIG. 6(C) is a sectional view taken along line B2-B2. The contact portion 208B of the female contact 200B comprises two inclined surfaces 210B, 212B and a flat surface 214B in the extending (axial) direction to provide a contact surface to the protruding portion 109B of the male contact 100B. That is, the inclined surfaces 210B, 212B and a flat surface 214B extend in the direction in which the protruding portion 109B of the male contact 100B moves on the contact portion 208B. The inclined surface 210B has an inclined surface which inclines at a direction substantially perpendicular to the axial direction or the movement direction of the contact portion 108B. The inclined surface 210B extends in the axial direction in length L1. The inclined surface 212B is formed continuously with the inclined surface 210B. The inclined surface 212B has an inclined surface which inclines in the direction opposite to the inclined surface 210B. The inclined surface 212B extends in the axial direction in length L2 The flat surface is formed continuously with the inclined portion 212B.

As shown in FIG. 6(B), the inclined surface 210B is inclined at the angle $\theta 1$ with respect to the flat portion 212B which is not inclined. As shown in FIG. 6(C), the inclined surface 212B is inclined at the angle $\theta 2$ with respect to the flat portion 214B which is not inclined. The angle $\theta 1$ is inclined in the direction opposite to the angle $\theta 2$. In an aspect, the inclined surfaces 210B, 212B are formed so that L1 is equal to L2 and $\theta 1$ is equal to $\theta 2$ ($L1=L2$ and $\theta 1=\theta 2$). Alternatively, the inclined surface 210B, 212B may be formed with $L1 \neq L2$ and $\theta 1 \neq \theta 2$.

Figure 7:
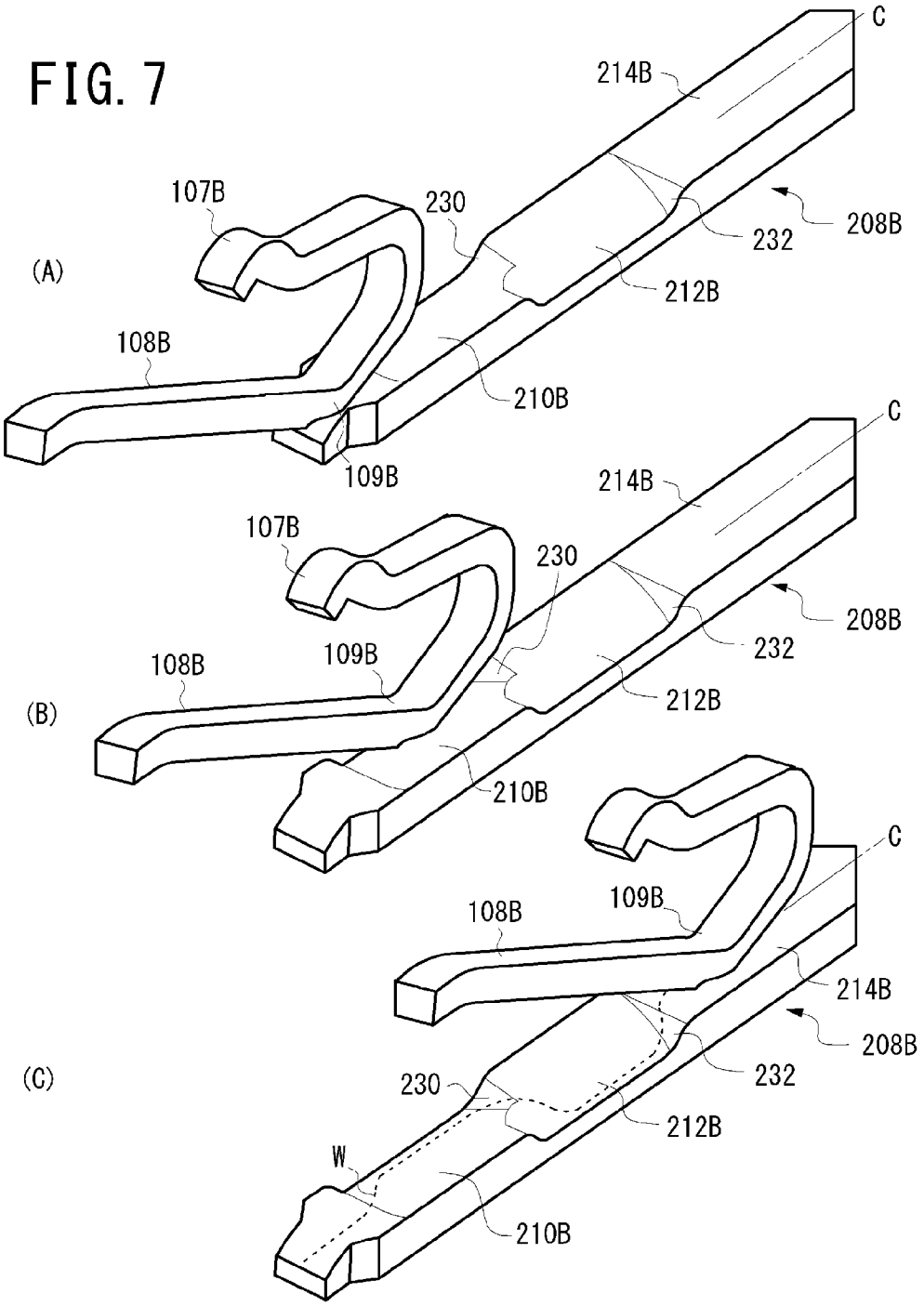
FIG. 7 is a perspective view illustrating the wiping operation between the contacts according to an embodiment of the present invention.

Note that the contact portion 208A of the other contact 200A is also formed with the inclined surface 210A, 212A. In case the inclined surfaces 210B, 212B, and the flat portion 214B are formed in the axial direction continuously, each step are generated at each boundary. Since each step may be a barrier for the movement of the protruding portion 109B or may cause a friction, a mitigated surface 230 such as a slope or a curved surface is provided for mitigating the step so that the protruding portion 109B can move smoothly and the frictions are reduces (shown in FIG. 7).

Figure 8:
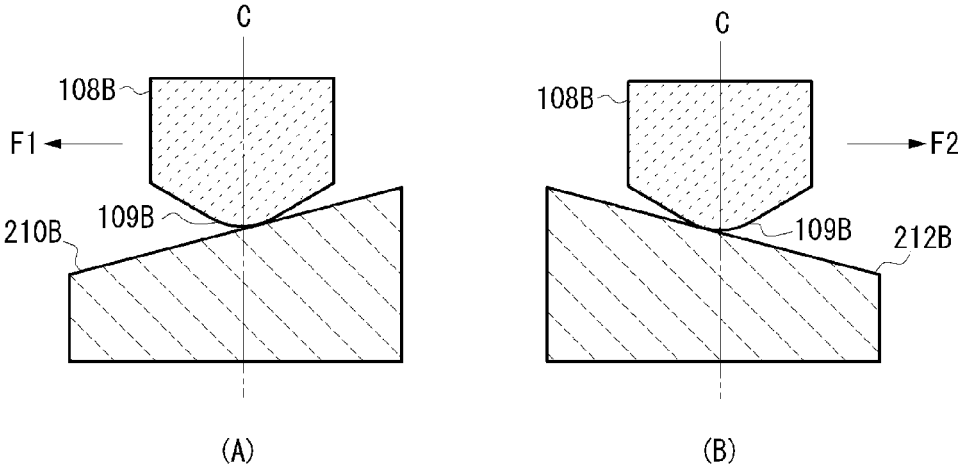
FIG. 8 is a sectional view illustrating the wiping operation between the contacts according to an embodiment of the present invention.
Figure 9:
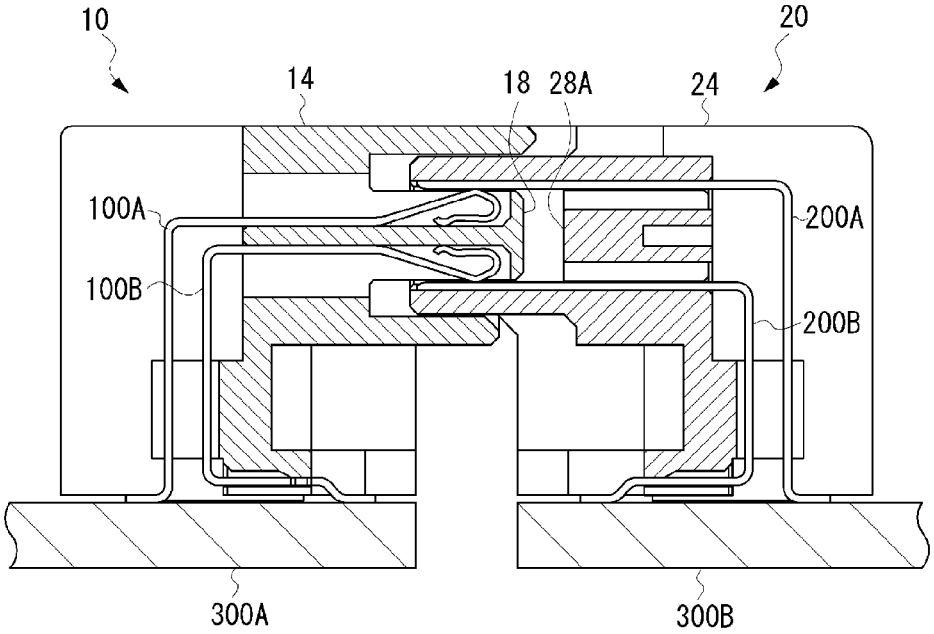
FIG. 9 is a sectional view illustrating a male connector mating with the female connector according to an embodiment of the present invention.

Now, the contact and wiping operations between the male contact and the female contact are described. FIGS. 7(A), 7(B) and 7(C) show perspective views with the male contact moved on the female contact. FIG. 8 shows a sectional view illustrating the relationship between the inclined surfaces 210B, 212B and the protruding portion 109B of the contact portion 108B of the male contact 100B. FIG. 9 shows a sectional view with the male connector 10 connected to the female connector 20.

As shown in FIG. 1(B), when the insertion portion 18 of the male connector 10 is inserted into the opening 28 of the female connector 28, the pair of male contacts 100A, 100B are connected to the pair of female contact 200A, 200B. As shown in FIG. 9, a substrate 300A is connected through the male contacts 100A, 100B to the male body 14, while a substrate 300B is connected through the female contact 200A, 200B to the female body 24.

FIG. 7(A) shows that the single contact portion 108B of the male contact 100B moves on the contact portion 208B of the female contact 208B. First, the protruding portion 109B of the male contact 100B is started to connect to the contact portion 208B of the female contact 200B. At this time, the protruding portion 109B is configured to move along a substantial axial center C of the contact portion 208B. The movement of the male connector 10 to the female connector 20 causes the protruding portion 109B to move on the contact portion 200B of the female contact 200B in the axial direction.

As shown in FIG. 7(B), when the protruding portion 109B of the male contact 100B reaches the inclined surface 210B of the contact portion 208B of the female contact 200B, the protruding portion 109B receives a force F1 corresponding to the inclined direction due to the inclined surface 210B (see FIG. 8(A)). The force F1 allows the movement of the protruding portion 109B to shift to the inclined direction from the axial center C of the contact portion 208B.

After the protruding portion 109B passes the inclined surface 210B, the protruding portion 109B moves on the inclined surface 212B. At this time, the protruding portion 109B receives a force F2 which acts in the direction opposite to the force in the inclined surface 210B, as shown in FIG. 8(B). The movement of the protruding portion 109B is shifted so as to return to the axial center C of the contact portions 208B by the force F2 and further shifted the inclined direction from the axial center C. Since the mitigated surface 230 is formed at the step between the inclined surface 210B and 212B, even if the protruding portion 109B passes over the step, the obstacles and/or loads for the movement of the protruding portion 109B is reduced.

The protruding portion 109B moves on the flat surface 214B after passing the inclined surface 212B. The mitigated surface 232 is provided at the step between the inclined surface 212B and the flat surface 214B, thus the movement of the protruding portion 109B is smoothed. When the insertion portion 18 of the male body 10 is abutted against a stopper 28A in the opening 28 of the female body 14 eventually (shown in FIG. 9), the engagement between the male and female connectors are completed.

A broken line W in FIG. 7(C) represents a wiping track. When the protruding portion 109B moves on the inclined surfaces 210B, 212B, the wiping track W meanders three-dimensionally in a zigzag manner due to the inclination of the inclined surfaces 210B, 212B. This allows extraneous materials attached onto the contact portion 208B to be eliminated effectively as compared to the conventional art in which a wiping track moves in the same direction as the protruding portion 109B. This is applied to the male contact 100A and the female contact 200A as well. As a result, desirable electrical contacts are obtained between the male contacts 100A, 100B and the female contacts 200A and 200B.

While the inclined surface 212B is formed continuously with the inclined surface 210B in the above embodiment, a flat surface with a certain length may be intervened between the inclined surfaces 210B and 212B. That is, the inclined surface 212B may be formed discontinuously with the inclined surface 210B. Further, more than two inclined surfaces may be provided. In this case, the inclined surfaces are connected to each other such that each inclination is inverted.

Also, the heights P1, P2 of the both sides of the inclined surface 210B may be P1<P2 as shown in FIG. 6(B). The heights Q1, Q2 of the both sides of the inclined surface 212B may be Q1>Q2 as shown in FIG. 6(C). In this case, the inclination of the inclined surfaces 210B, 212B may be formed by stamping. In an aspect, the sides may be formed with P1=Q2 and P2=Q2. In another aspect, the sides may be formed with P1≠Q2 and P2≠Q2. In further another aspect, the sides where the inclined surface 210B, 212 are formed with P1=P2 and Q1=Q2. In this case, the inclination of the inclined surfaces 210B, 212B may be formed by twisting the contact portion 208B.

Figure 10:
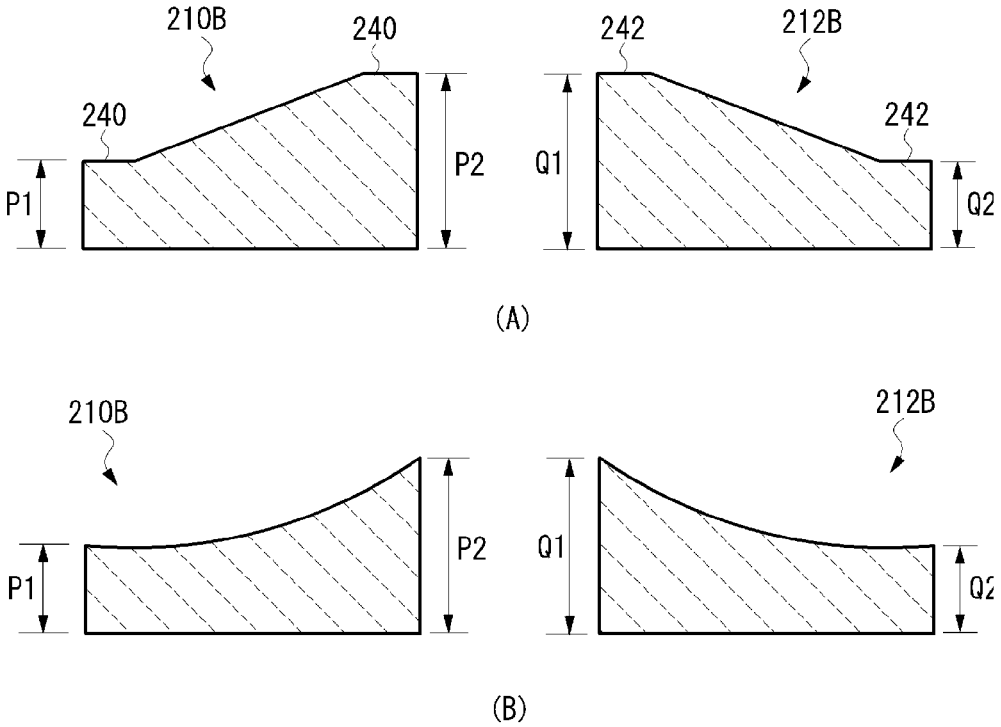
FIG. 10 is a sectional view illustrating a modification of a female connector according to an embodiment of the present invention.

FIG. 10 is a sectional view illustrating modifications of a contact portion of a female contact according to the present invention. As shown in FIG. 10(A), flat portions 240, 242 may be provided at the both sides of the inclined surfaces 210A, 210B. In this case, the inclined or curved surface is provided to alleviate the step between the flat portions 240, 242. As shown in FIG. 10(B), the curved slope may be provided as the inclined surface 210A, 210B, instead of the linear slope.

The preferred embodiments according to the present invention are described above. The present invention is not limited to the particular embodiment. Various changes and modifications may be made without departing from the spirit and scope of the present invention.

DESCRIPTION OF THE REFERENCE NUMERALS

10: male connector
14: female connector
18 insertion portion
20 female connector
24: female body
28: opening
28A: stopper
30 contact mounting portion
32A, 32B: opening
34: partition wall
36, 38: groove
40: contact mounting portion
42A, 42B: opening
44: partition wall
46, 48: groove
100A, 100B: Male contact
102A, 102B: base portion
104A, 104B: extending portion
106A, 106B: bent portion
108A, 108B: contact portion
109A, 109B: protruding portion
200A, 200B: male contact
202A, 202B: base portion
204A, 204B: extending portion
206A, 206B: bent portion
208A, 208B contact portion
210B, 212B: inclined surface
214B: flat surface
230, 232: mitigated surface
240, 242: flat surface

What is claimed is:

1. A connector for connecting a male contact to a female contact, comprising:

the male contact including an elastically deformable protruding portion at an end thereof; and the female contact including a contact surface for contacting with the protruding portion, the contact surface elongated in a direction in which the protruding portion moves during slideable insertion or removal, the contact surface including a first inclined surface which inclines in a first direction different form the direction of the movement of the protruding portion and a second inclined surface which inclines in a second direction opposite to the first direction, the first inclined surface and the second inclined surface are formed continuously and slope is provided at a step between the first inclined surface and the second inclined surface.

2. The connector according to claim 1, wherein an inclination angle of the first inclined surface is equal to the inclination of the second inclined surface.

3. The connector according to claim 1, wherein the first inclined surface and the second inclined surface are spherical shaped.

4. The connector according to claim 1, wherein a pair of the female contacts are disposed oppositely, and the pair of the male contacts are disposed such that the pair of the protruding portions are contacted with the pair of the contact surfaces respectively.

5. The connector according to claim 1, wherein a pair of the contact surfaces are supported to contact with a top surface and a bottom surface of an opening, and the pair of the protruding portions are supposed elastically at a top surface and a bottom surface of an insertion portion inserted into the opening.

6. The connector according to claim 1 further comprising; a male connector having a plurality of male contacts and the insertion portion; and a female connector having a plurality of female contacts and the opening, wherein each of the plurality of the male contacts is contacted with each of the plurality of the female contacts when the insertion portion is inserted into the opening.

7. The connector according to claim 1, wherein the male connector and the female connector are secured to a substrate through the male contacts and the female contacts.

8. The connector according claim 1, wherein the inclination angle of the first inclined surface is equal to the inclination of the second inclined surface.

9. The connector according to claim 2, wherein the first inclined surface and the second inclined surface are spherical shaped.

10. The connector according to claim 3, wherein a pair of the female contacts are disposed oppositely, and the pair of the male contacts are disposed such that the pair of the protruding portions are contacted with the pair of the contact surfaces respectively.

11. The connector according to claim 4, wherein a pair of the contact surfaces are supported to contact with a top surface and a bottom surface of an opening, and the pair of the protruding portions are supposed elastically at a top surface and a bottom surface of an insertion portion inserted into the opening.

12. The connector according to claim 5, further comprising; a male connector having a plurality of male contacts and the insertion portion; and a female connector having a plurality of female contacts and the opening, wherein each of the plurality of the male contacts is contacted with each of the plurality of the female contacts when the insertion portion is inserted into the opening.

13. The connector according to claim 6, wherein the male connector and the female connector are secured to a substrate through the male contacts and the female contacts.

14. The connector of claim 1, wherein the first and second inclined surfaces bias the protruding portion in opposed lateral directions from the contact surface.

15. The connector of claim 1, further comprising a mitigated surface for mitigating a step between the first inclined surface and the second inclined surface such that that the protruding portion disposes smoothly with reduced friction.

* * * * *